US008928224B2

(12) United States Patent
Sugita et al.

(10) Patent No.: US 8,928,224 B2
(45) Date of Patent: Jan. 6, 2015

(54) LAMP

(75) Inventors: Kazushige Sugita, Hyogo (JP); Tamotsu Ando, Osaka (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 0 days.

(21) Appl. No.: 13/576,342

(22) PCT Filed: Jan. 20, 2011

(86) PCT No.: PCT/JP2011/000285

§ 371 (c)(1),
(2), (4) Date: Jul. 31, 2012

(87) PCT Pub. No.: WO2011/096165

PCT Pub. Date: Aug. 11, 2011

(65) Prior Publication Data

US 2012/0299479 A1 Nov. 29, 2012

(30) Foreign Application Priority Data

Feb. 4, 2010 (JP) ..... 2010-023262

(51) Int. Cl.
*H01J 23/16* (2006.01)
*H05B 33/08* (2006.01)

(52) U.S. Cl.
CPC ..... *H05B 33/0893* (2013.01); *H05B 33/0854* (2013.01)
USPC ..... 315/74; 315/32; 315/44; 315/119

(58) Field of Classification Search
USPC ..... 315/32, 127, 125, 119, 306, 307, 308, 315/310, 41, 44, 50, 71, 74
See application file for complete search history.

(56) References Cited

U.S. PATENT DOCUMENTS

| | | | |
|---|---|---|---|
| 2005/0206529 | A1 | 9/2005 | St. Germain |
| 2009/0066253 | A1 | 3/2009 | Morimoto et al. |

FOREIGN PATENT DOCUMENTS

| | | |
|---|---|---|
| EP | 1 098 550 | 5/2001 |
| JP | 2006-236646 | 9/2006 |
| JP | 2006-278238 | 10/2006 |
| JP | 2006-278324 | 10/2006 |
| JP | 2009-033098 | 2/2009 |
| JP | 2009-176925 | 8/2009 |
| JP | 2010-129210 | 6/2010 |
| WO | 2007/022409 | 2/2007 |

*Primary Examiner* — Douglas W Owens
*Assistant Examiner* — Jianzi Chen
(74) *Attorney, Agent, or Firm* — Hamre, Schumann, Mueller & Larson, P.C.

(57) ABSTRACT

There is provided a lamp capable of informing a user that the LED lamp is at the end of its productive life and urging the user to replace the lamp reliably with a simple configuration. The lamp includes: a light emitting diode (1) as a light source; and a driving circuit (3) that turns on the light emitting diode (1) by an alternating-current or direct-current power source. The lamp further includes a life detecting element (2) that turns off the light emitting diode (1) following the occurrence of insulation deterioration in a resin material when the light emitting diode (1) has been operated for a predetermined time.

10 Claims, 9 Drawing Sheets

LAMP

TECHNICAL FIELD

The present invention relates to a lamp having a light emitting diode (LED) as a light source.

BACKGROUND ART

In recent years, from the viewpoint of global environmental protection, lamps using a low-power and long-life light emitting diode (hereinafter, referred to as an "LED" in the present specification) as a light source are becoming popular. In particular, the development of a high-intensity white LED has made the LED available for widespread use, allowing an LED lamp incorporating the LED and a driving circuit for turning on the LED to come into frequent use not only as a surface light source type lighting apparatus but also as household lighting, for which the LED has not been used conventionally because of its high cost or the like, as an alternative to an incandescent lamp, a fluorescent tube, and a bulb shape fluorescent lamp.

As such a bulb shape LED lamp to be used as an alternative to an incandescent lamp for use in a lighting apparatus for an incandescent lamp, it is proposed to arrange a heat sink plate on which the LED is mounted and a circuit board on which a driving circuit is mounted apart from each other, thereby preventing electronic components on the driving circuit board from being damaged by the heat generated when light is emitted from the LED (see Patent Document 1).

PRIOR ART DOCUMENT

Patent Document

Patent Document 1: JP 2009-176925 A

DISCLOSURE OF INVENTION

Problem to be Solved by the Invention

The LED characterized by long lasting qualities is highly advantageous as a light source. However, a lamp that uses the LED as a light source and incorporates the driving circuit poses a new problem in relation to the deterioration life of the circuit board itself used for the driving circuit for turning on the LED or mounted circuit components, especially its connecting portion.

Considering that an LED element itself can be used semi-permanently, the product life of an LED lamp is supposed to expire when the amount of light emitted from the LED lamp has dropped to or below a certain level due to a decrease in translucency caused by deterioration of the resin sealing the LED. Even assuming that the lamp comes to the end of its life when the resin deteriorates, the lamp will last for more than 30000 to 40000 hours. For example, in the case where the lamp is turned on for about 10 hours per day, then the operating time per year will be about 3000 hours. Accordingly, an operating time of 30000 hours will be covered in 10 years. Meanwhile, in the case where the LED lamp is used for a long time, such as 10 years or more, wiring of a printed board used as the driving circuit for the LED, the circuit components such as a capacitor, and further a solder material connecting the wiring and the circuit components will be deteriorated earlier, resulting in conduction failure, a short circuit, or the like. Namely, the life of the driving circuit expires before the LED stops emitting light or has its brightness decreased. This problem cannot be avoided even by taking measures described in Patent Document 1. If connection failure or the like occurs in the driving circuit before the life of the LED as a light source expires, serious troubles such as abnormal heat generation and flames may be caused in a portion where the failure occurs.

Further, in ordinary households where a bulb shape LED lamp or a straight tube LED lamp is used as an alternative to an incandescent lamp or a straight tube fluorescent lamp, respectively, a user is less likely to replace the lamp until almost no light is emitted from the lamp. More specifically, since the product life of conventional incandescent lamps and fluorescent tubes is obviously shorter than that of the circuit components used in the lighting apparatus, the user has an established perception that the lamp is to be replaced only after the brightness of the lamp has been decreased significantly.

It is difficult to change such a user's perception immediately, and it is not sufficient to provide the lamp with, as a means for urging the user to replace the lamp, a life management part such as a timer to inform the user that the lamp is at the end of its life. Consequently, adding a means for managing life and informing the user of the life only leads to an unnecessary increase in cost and lamp capacity without ensuring that the lamp is replaced reliably, which may result in an unexpected event that occurs due to failure in the driving circuit.

It is an object of the present invention to solve the above-described problems of a conventional LED lamp and to provide a lamp capable of informing a user that the LED lamp is at the end of its productive life and urging the user to replace the lamp reliably with a simple configuration.

Means for Solving Problem

In order to solve the above-described problems, a lamp according to the present invention includes: a light emitting diode as a light source; and a driving circuit that turns on the light emitting diode by an alternating-current or direct-current power source. The lamp further includes a life detecting element that turns off the light emitting diode following the occurrence of insulation deterioration in a resin material when the light emitting diode has been operated for a predetermined time.

Namely, a lamp according to the present invention is characterized by a light emitting diode and a driving circuit that turns on the light emitting diode, and further a life detecting element that turns off the light emitting diode according to changes in electrical characteristics caused depending on the operating time of the light emitting diode.

Effects of the Invention

According to the lamp of the present invention, the life detecting element using a resin material in which insulation deterioration occurs turns off the light emitting diode being turned on when the light emitting diode has been operated for a predetermined time. Thus, it is possible to inform a user that the lamp including the driving circuit is at the end of its productive life and urge the user to replace the lamp reliably.

BRIEF DESCRIPTION OF DRAWINGS

FIG. 1A shows a film capacitor arranged in parallel with an entire connection body in which a plurality of LEDs are connected in series, and FIG. 1B shows the film capacitor arranged in parallel with a part of the LEDs in the connection body in which the plurality of LEDs are connected in series.

Figure 1A:
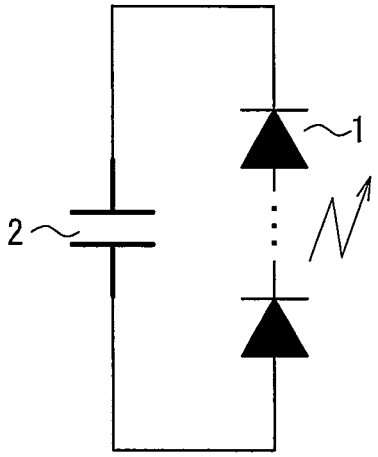
FIGS. 1A and 1B are circuit block diagrams showing a first exemplary arrangement of a life detecting element in a lamp according to an embodiment of the present invention.

A lamp according to the present invention includes: a light emitting diode as a light source; and a driving circuit that turns on the light emitting diode by an alternating-current or direct-current power source. The lamp further includes a life detecting element that turns off the light emitting diode following the occurrence of insulation deterioration in a resin material when the light emitting diode has been operated for a predetermined time.

The lamp according to the present invention uses, as the life detecting element, a circuit element designed to change in electrical characteristics when the light emitting diode has been operated for a predetermined time by the use of a phenomenon in which insulation deterioration occurs in the resin material under the action of heat generated when the light emitting diode is operated. The life detecting element is arranged so that at least a part of the light emitting diode is turned off forcibly when the element changes in circuit characteristics by being subjected to the action of heat generated by the light emitting diode for a predetermined time, thereby preventing the lamp whose predetermined design lifetime has elapsed from being operated normally. Thus, with respect to the lamp having the light emitting diode as a light source, it is possible to urge a user to replace the lamp before the driving circuit, whose life is shorter than that of the light emitting diode, is deteriorated.

In the lamp according to the present invention, the life detecting element can be a film capacitor arranged in parallel with at least a part of the light emitting diode. Consequently, it is possible to turn off a predetermined number of the light emitting diodes after a predetermined operating time has elapsed with a simple configuration.

Alternatively, the life detecting element can be a film capacitor constituting the driving circuit for the light emitting diode. Consequently, it is possible to manage the life of the lamp without adding a special element.

Alternatively, the life detecting element can be a coil with a resin-coated winding. Consequently, it is possible to manage the life of the lamp using a phenomenon in which insulation deterioration occurs in the resin material with a simple configuration, as in the case of the film capacitor.

It is desirable that the life detecting element is arranged at a distance of 10 mm or less from a light emitting portion of the light emitting diode. By arranging the life detecting element in the vicinity of the light emitting diode in this manner, the degree of insulation deterioration in the resin material due to heat generated by the light emitting diode can be adjusted to a design value, which allows the light emitting diode to be turned off more accurately according to the operating time of the light emitting diode.

In this case, it is preferable that the light emitting diode has a temperature of 50° C. or more during operation. Consequently, the life detecting element can detect the operating time more accurately.

Further, it is preferable that the life detecting element is arranged at a distance of 10 mm or less from a heat sink plate provided for dissipating heat of the light emitting diode or a housing accommodating the light emitting diode. By arranging the life detecting element in the vicinity of the heat sink plate or the like to which heat generated by the light emitting diode is transferred, the degree of insulation deterioration in the resin material due to heat generated by the light emitting diode can be adjusted to a design value, which allows the light emitting diode to be turned off more accurately according to the operating time of the light emitting diode.

In this case, it is preferable that the heat sink plate or the housing has a temperature of 50° C. or more during an operation of the light emitting diode. Consequently, the life detecting element can detect the operating time more accurately.

Namely, the present invention relates to a lamp including a light emitting diode and a driving circuit that turns on the light emitting diode, and further including a life detecting element that turns off the light emitting diode according to changes in electrical characteristics caused depending on the operating time of the light emitting diode.

The present invention adopts a new technical idea in which, even in the case where the light emitting diode as a light source is not at the end of its life, the lamp is turned off forcibly or has its intensity reduced significantly in accordance with the other circuit components whose life will expire earlier, thereby urging a user to replace the lamp. Therefore, it is possible to provide the lamp capable of effectively preventing the occurrence of a serious situation where, for example, the circuit components constituting the driving circuit are deteriorated, causing heat generation or fire.

Hereinafter, a lamp according to the present invention will be described with reference to the drawings.

It should be noted that each figure, which will be referred to in the following, shows only main members required for describing the present invention among the constituent members of the lamp of the present invention, in a simplified manner for convenience of explanation. Thus, the lamp according to the present invention can include arbitrary constituent members not shown in each figure referred to. Further, the size and size ratio of the members in each figure do not exactly reflect those of actual constituent members.

(Life Detecting Element and Exemplary Arrangement Thereof)

First, details of a life detecting element used in the lamp of the present invention and a position where it is arranged will be described as an embodiment of the present invention. The life detecting element of the present invention is an element that changes in electrical characteristics depending on the operating time of a light emitting diode (LED) as a light source of the lamp, and forcibly turns off the light emitting diode being turned on when the LED has been operated for more than a predetermined time.

Figure 1B:
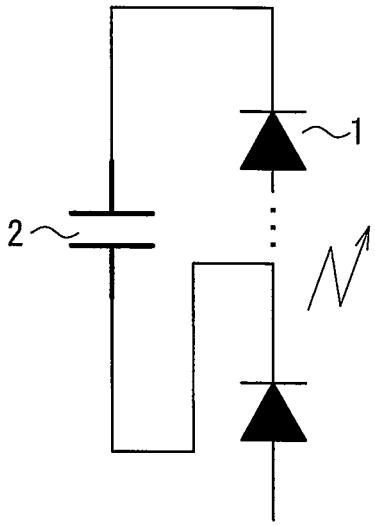

FIGS. 1A and 1B are circuit block diagrams showing a first exemplary arrangement of the life detecting element used in the lamp according to the embodiment of the present invention.

In the first exemplary arrangement of the life detecting element of the present embodiment as shown in FIGS. 1A and 1B, a film capacitor 2 as the life detecting element is arranged in parallel with LEDs 1 as light sources.

The film capacitor 2 has a structure in which a resin film as an insulator is sandwiched between metal foils as electrodes. It should be noted that, among capacitors having a resin film as an insulator, a metalized electrode capacitor in which a metal coating is applied to resin cannot be used as the life detecting element because it will have an increased resistance at the end of its deterioration life. Also, an electrolytic capacitor, a tantalum capacitor, a ceramic capacitor for a snubber, and the like cannot be used as the life detecting element because they will have an increased resistance at the end of their deterioration life.

In the case where the film capacitor 2 has a withstand voltage of 250 V, for example, polyester, polypropylene, polyethylene terephthalate, mica, silicone resin, or the like having a thickness of about 5 to 15 μm is used generally as an insulator. It should be noted that the specific thickness of the insulator is determined based on an individual design value in accordance with a lifetime to be detected by the film capacitor 2 as described below.

It is known that the following Arrhenius' equation holds for many substances including an insulator made of resin.

$$k=A\times\exp(-Ea/(R*T)) \quad \text{[Formula 1]}$$

k=Reaction rate constant
A=Constant
Ea=Activation energy
R=Gas constant=8.3144 J/(K*mol)
T=Temperature (k)

The Arrhenius' equation shows that the reaction rate constant varies with the environmental temperature of a substance. In the case of an insulator, the degree of insulation deterioration can be known from the environmental temperature of the substance. Thus, it is possible to ascertain the degree of insulation deterioration in a predetermined insulator based on the result of an accelerated test and accordingly to define the time until the film capacitor is destroyed following insulation deterioration.

As shown in FIG. 1A, the film capacitor 2 is arranged in parallel with both ends of a connection body in which the plurality of LEDs 1 are connected in series so as to be driven by a constant current. With this arrangement, the film capacitor 2 is exposed to a predetermined environmental temperature due to heat generated by the LEDs 1 during the operation of the LEDs 1. Upon the expiration of the lifetime that has been ascertained in advance, the insulating foil of the film capacitor 2 is destroyed following deterioration by heat and begins conducting. Then, no current flows through the connection body of the LEDs 1, which allows all the LEDs 1 in the connection body to be turned off even if they are not at the end of their life.

Alternatively, as shown in FIG. 1B, the film capacitor 2 can be arranged in parallel with a part of the connection body in which the plurality of LEDs 1 are connected in series so as to be driven by a constant current. With this arrangement, when the film capacitor 2 is destroyed, the LEDs 1 located in a portion in parallel with the film capacitor 2 are turned off. By turning off only a part of the connection body of the LEDs 1 in this manner, it is possible to avoid having a user replace the lamp under difficult conditions where the lamp at the end of its life goes out completely. However, as described in the section of Problem to be Solved by the Invention, the user may be less likely to feel the need to replace the lamp when the lamp has its intensity reduced only slightly. In view of this, in order to urge the user to replace the lamp, it is preferable that the number of the LEDs 1 allowed to remain turned on is smaller than the number of the LEDs 1 to be turned off such that, for example, the number of the LEDs 1 allowed to remain turned on is ⅓ or less of the whole.

Depending on the type of the lamp, a plurality of the serial bodies of the LEDs may be used to obtain the necessary brightness. Also in such a case, it is possible to appropriately determine how many LEDs in the plurality of connection bodies should be turned off to the extent that the user can be informed of the expiration of the lamp life and made aware of the need to replace the lamp. Needless to say, in the case where the lamp has one LED 1, this LED is turned off.

As described above, in the film capacitor 2 as the life detecting element of the present embodiment, the resin film as an insulator made of resin is made of a predetermined material and has a predetermined thickness, thereby allowing the resin film to be broken down and brought into conduction after exposure to heat generated by the LEDs 1 being turned on for a predetermined time. Therefore, it is possible to set the lifetime of the lamp to an arbitrary extent that no breakdown occurs in a member having the shortest life or a junction between members in an LED driving circuit for turning on the LEDs 1.

As is evident from the above description, the film capacitor 2 as the life detecting element of the present embodiment can detect a time during which the LED lamp is turned on because the degree of insulation deterioration in the insulating film at a time when it is at an environmental temperature showing that the LEDs 1 are turned on is ascertained in advance. To this end, it is important that the film capacitor 2 is arranged at a position close enough to be affected by heat generated by the LEDs 1 being turned on.

The inventors have confirmed that the distance between a light emitting portion of the LEDs 1 and the film capacitor 2 is preferably 10 mm or less. However, this numerical value of the distance applies to the case where the LEDs 1 and the film capacitor 2 are accommodated in a common lamp housing, and no forced circulation of air or the like is caused in the lamp housing. In the case where air moves between the LEDs 1 and the film capacitor 2, less heat is conducted from the LEDs 1, and thus naturally the LEDs 1 and the film capacitor 2 should be spaced at a smaller distance from each other or preferably in intimate contact with each other.

As described later in specific examples of a bulb shape LED lamp, a straight tube LED lamp, and the like, the lamp having the LED 1 as a light source includes a heat sink plate for facilitating heat dissipation of the LED 1 or uses a lamp housing as a heat sink plate. Since the heat sink plate or the housing is a member for positively transferring heat generated by the LED 1, its temperature can be made detectable by the film capacitor 2 as the life detecting element. Also in this case, it was found that, in order to allow the film capacitor 2 to be arranged at a position close enough to be affected by heat transferred from the LED 1 being turned on to the heat sink plate or the like, the distance therebetween is preferably 10 mm or less. This numerical value applies on the assumption that the LED 1, the heat sink plate, and the like are covered with the lamp housing, and no forced circulation of air is caused, as in the above-described case where heat generated by the LED is detected directly.

The film capacitor 2 as the life detecting element of the present embodiment detects a time during which the LED 1 is turned on based on the amount of heat generated by the LED 1. Thus, in order to precisely distinguish between a state where the LED 1 is turned on and a state where the LED 1 is turned off, it is preferable that there is at least a certain level of temperature difference between these states.

According to the study by the inventors, the following was found. In the case where the film capacitor 2 detects the temperature of the LED 1 itself, it is preferable that the light emitting portion of the LED 1 has a temperature of 50° C. or more. Similarly, also in the case where the film capacitor 2 detects the temperature of the heat sink plate or the housing for dissipating heat of the LED 1, it is preferable that the heat sink plate or the like has a temperature of 50° C. or more.

If an environment in which the lamp is to be used is known, it is also possible to design the insulator of the film capacitor 2 as the life detecting element such that the material, the film thickness, and the like of the insulator of the film capacitor 2 are adjusted in accordance with the environment. For example, when the environment in which the lamp is to be used has a constantly low temperature, heat generated by the LED 1 easily is dissipated from the lamp housing to the outside. Thus, the lamp life should be designed in view of this point.

Figure 2:
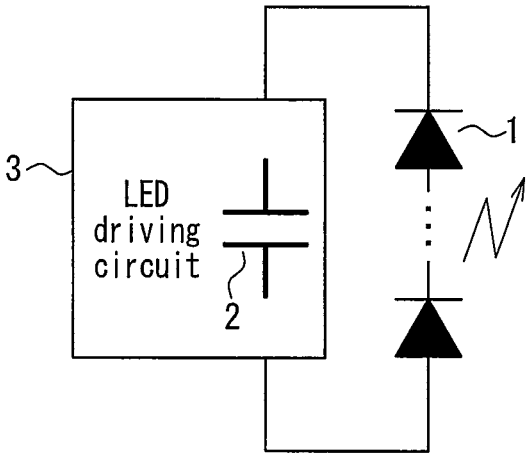
FIG. 2 is a circuit block diagram showing a second exemplary arrangement of the life detecting element in the lamp according to the embodiment of the present invention. The film capacitor is used as a circuit element of an LED driving circuit.

Next, FIG. 2 is a circuit block diagram showing a second exemplary arrangement of the life detecting element used in the lamp according to the embodiment of the present invention.

As shown in FIG. 2, a capacitor used in an LED driving circuit 3 for turning on the LEDs 1 can be used as the film capacitor 2 as the life detecting element of the lamp of the present embodiment. Consequently, it is possible to ascertain the operating time of the LEDs 1 and turn off the LEDs 1 after a predetermined time has elapsed without providing a new element dedicated to the detection of life.

Figure 3:
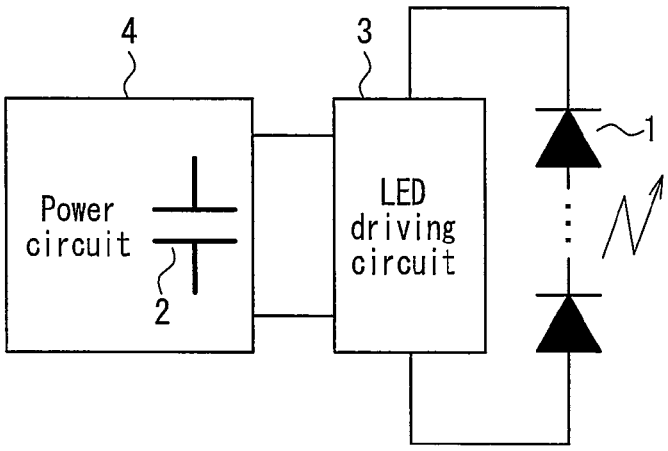
FIG. 3 is a circuit block diagram showing a third exemplary arrangement of the life detecting element in the lamp according to the embodiment of the present invention. The film capacitor is used in a power circuit of the LED driving circuit.

FIG. 3 is a circuit block diagram showing a third exemplary arrangement of the life detecting element used in the lamp according to the embodiment of the present invention.

As shown in FIG. 3, a capacitor used in a power circuit 4 for supplying a voltage to the LED driving circuit 3 for turning on the LEDs 1 can be used as the film capacitor 2 as the life detecting element of the lamp of the present embodiment. Consequently, it is possible to ascertain the operating time of the LEDs 1 and turn off the LEDs 1 after a predetermined time has elapsed without providing a new element dedicated to the detection of life.

Figure 4:
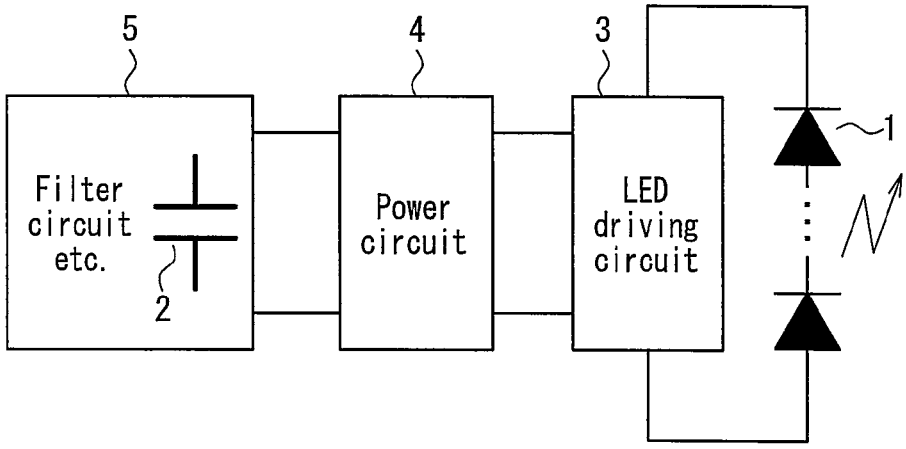
FIG. 4 is a circuit block diagram showing a fourth exemplary arrangement of the life detecting element in the lamp according to the embodiment of the present invention. The film capacitor is used in a filter circuit connected to the LED driving circuit.

FIG. 4 is a circuit block diagram showing a third exemplary arrangement of the life detecting element used in the lamp according to the embodiment of the present invention.

As shown in FIG. 4, a capacitor used in a filter circuit 5 provided as needed in the LED driving circuit 3 for turning on the LEDs 1 can be used as the film capacitor 2 as the life detecting element of the lamp of the present embodiment. Consequently, it is possible to ascertain the operating time of the LEDs 1 and turn off the LEDs 1 after a predetermined time has elapsed without providing a new element dedicated to the detection of life.

As shown in FIGS. 2 to 4, any of the predetermined capacitors in the respective circuit blocks of the driving circuit for driving the LEDs 1 can be used as the film capacitor 2 as the life detecting element of the lamp of the present embodiment. In each of the examples shown in FIGS. 3 and 4, one film capacitor 2 as the life detecting element is provided in either of the circuit blocks. However, there is no need to provide only one life detecting element in the present invention, and a plurality of the film capacitors 2 as the life detecting elements also can be provided in one or two or more circuit blocks as needed.

Among the capacitors used in the respective circuit blocks, as a capacitor for preventing ringing of the circuit, for example, an electrolytic capacitor is used, whereas the film capacitor is not preferable in terms of electrical characteristics. In such a case, needless to say, the film capacitor should not be used as the capacitor for preventing ringing of the circuit but should be used only in a portion where no problem arises in terms of circuit characteristics.

Figure 5:
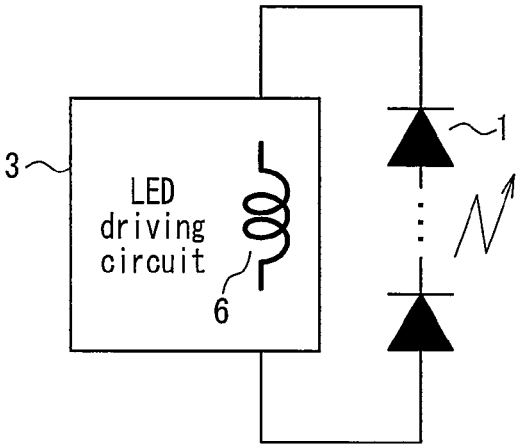
FIG. 5 is a circuit block diagram showing a fifth exemplary arrangement of the life detecting element in the lamp according to the embodiment of the present invention. A detection coil with a resin-coated winding is used in the LED driving circuit.

Next, FIG. 5 is a circuit block diagram showing a fifth exemplary arrangement of the life detecting element of the lamp of the present embodiment, in which a coil (inductance), instead of the film capacitor, is used.

As shown in FIG. 5, a detection coil 6 as the life detecting element of the lamp of the present invention can be used as a coil used in the LED driving circuit 3 for turning on the LEDs 1.

The detection coil 6 has a coil winding with an insulating coating film made of resin. This resin coating is designed with respect to its material and thickness based on the result of an accelerated test or the like on the principle of the Arrhenius' equation so that insulation deterioration proceeds, establishing conduction between adjacent windings in a predetermined operating time as in the case of the insulating foil of the film capacitor as described above. When conduction is established between the adjacent windings, a secondary loop is provided, causing the inductance value to change. As a result, no normal current can flow, thereby allowing the LEDs 1 to be turned off. Thus, the detection coil 6 arranged in the driving circuit can serve as the life detecting element similarly to the film capacitor 2, making it possible to urge the user to replace the lamp by turning off the lamp in a state where the LEDs 1 are not at the end of their life.

As described above, also in the case of using the detection coil 6, the same principle of turning off the LEDs 1 after they have been turned on for a predetermined time is used as in the case of using the film capacitor 2. Thus, regarding the temperatures of the light emitting portion of the LEDs 1 as heat generation sources, the heat sink plate, and the housing, the positional relationship between the heat generation sources and the detection coil 6, and the like, the above conditions described for the film capacitor are applicable. Also, it is the same as in the case of using the film capacitor as the life detecting element that in the case where a plurality of the serial connection bodies of the LEDs 1 are provided, a part of the LEDs 1 can be turned off as needed.

Next, specific exemplary configurations of the lamp having the LED as a light source according to the present embodiment will be described with reference to the drawings.

(Exemplary Configuration of Bulb Shape LED Lamp)

Figure 6:
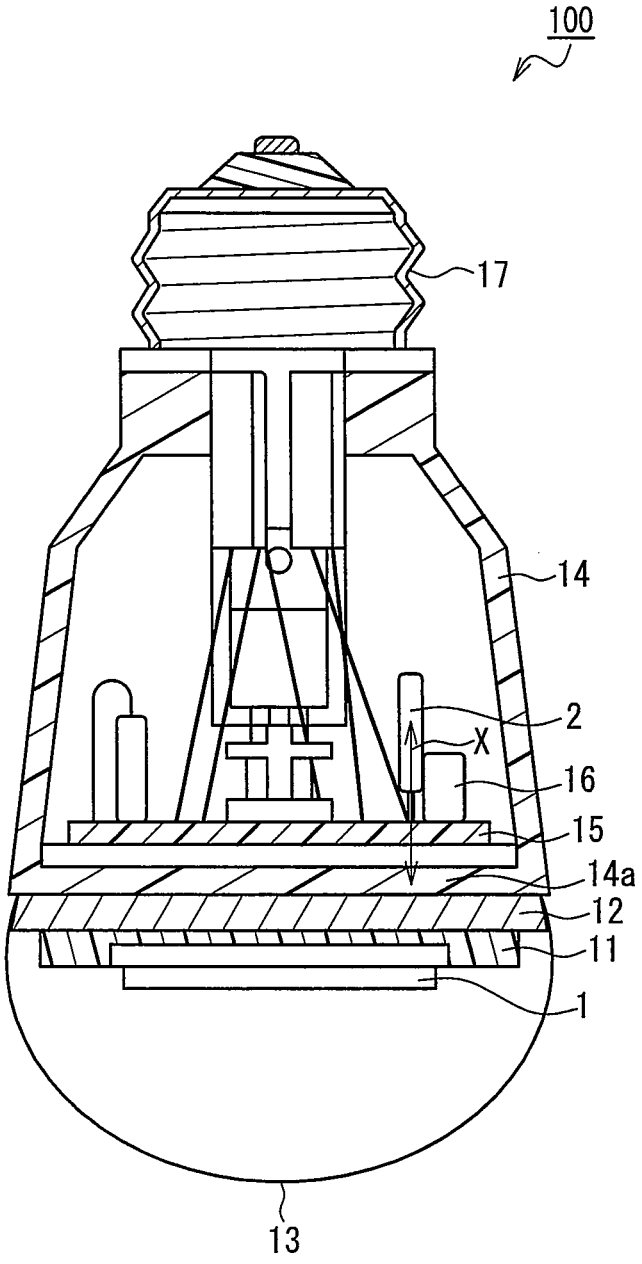
FIG. 6 is a cross-sectional view showing a first specific configuration of a bulb shape lamp as a production example of the lamp according to the embodiment of the present invention.

FIG. 6 is a cross-sectional view showing a first exemplary configuration of a bulb shape LED lamp as the lamp of the present embodiment that can replace an incandescent lamp.

As shown in FIG. 6, according to a first bulb shape LED lamp 100 of the present embodiment, an LED mounting board 11 made of glass, ceramic, or metal such as aluminum on which the LED 1 as a light source is mounted and a heat sink plate 12 made of glass, ceramic, or metal such as aluminum for transferring heat generated by the LED 1 to a lamp housing 14 are covered with a transparent or semitransparent cover member 13 made of resin or glass. In FIG. 6, the LED 1 as a light source is shown as a surface light source having a predetermined area. However, the LED 1 as a light source in the present embodiment is not limited to the surface light source, but may be composed of a plurality of LED elements arranged on the LED mounting board 11.

The lamp housing 14 made of glass, ceramic, or metal such as aluminum connects the cover member 13 and a base 17. In the lamp housing 14, driving circuit elements 16 such as a capacitor, a choke coil, a resistance, and a semiconductor are arranged on a driving circuit board 15 on which an LED driving circuit for turning on the LED 1 by an alternating-current power source supplied from the base 17 is mounted, and are connected to each other by circuit wiring (not shown) formed on a surface of the driving circuit board 15. The LED driving circuit in the first bulb shape LED lamp 100 of the present embodiment may be a conventional driving circuit for an LED lamp, and thus it is not shown in the drawing, and a detailed description thereof will be omitted.

The film capacitor 2 as the life detecting element is mounted on the driving circuit board 15 as a part of the driving circuit, and detects the heat generated when the LED 1 is turned on from an LED mounting portion 14*a* of the lamp housing 14 located on a back surface side of the driving circuit board 15 via the LED mounting board 11 and the heat sink plate 12. To this end, the film capacitor 2 in the first bulb shape LED lamp 100 of the present embodiment is arranged at a distance x of 10 mm or less as a predetermined value from the LED mounting portion 14*a* of the lamp housing 14.

As described above, the first bulb shape LED lamp 100 of the present embodiment uses the film capacitor 2 also as a circuit component constituting the driving circuit, thereby detecting a time during which the LED 1 is turned on and turning off at least a part of the LED 1 after a predetermined operating time has elapsed, without adding a special element dedicated to detecting the lamp life. Further, since heat generated by the LED 1 is detected from the LED mounting portion 14*a* of the housing 14, the film capacitor 2, which is a tall component, can be arranged in a central portion in the housing 14 where enough space is provided, thereby allowing the bulb shape LED lamp 100 to be compact.

Figure 7:
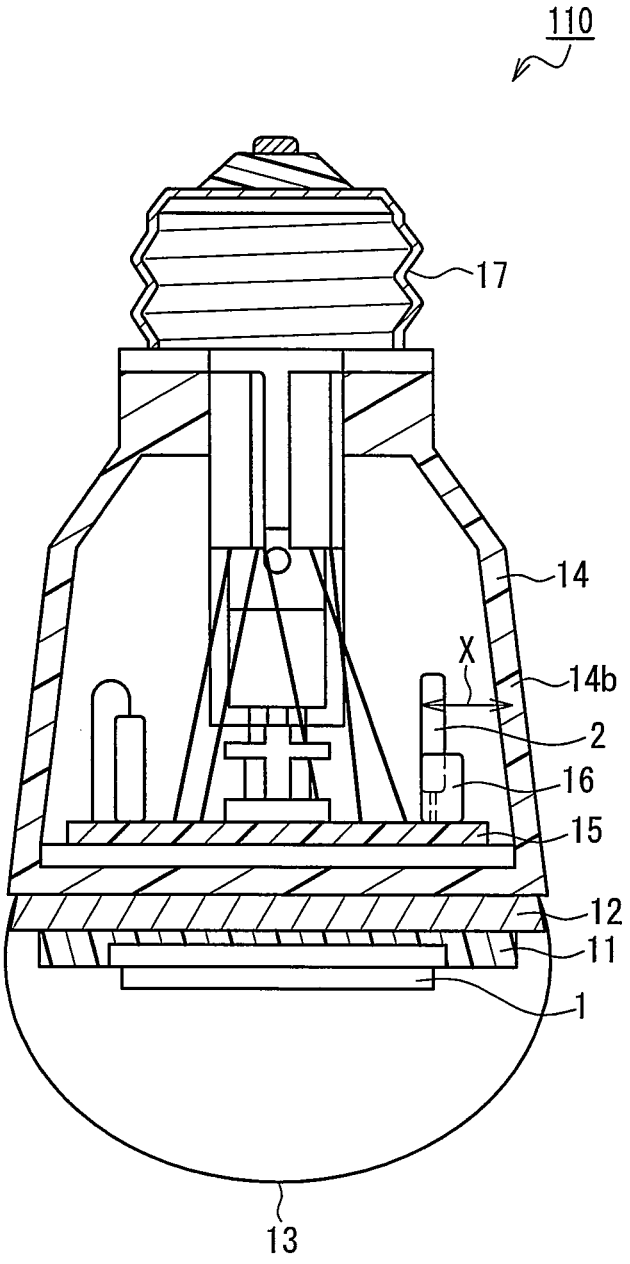
FIG. 7 is a cross-sectional view showing a second specific configuration of the bulb shape lamp as a production example of the lamp according to the embodiment of the present invention.

FIG. 7 is a cross-sectional view showing a second exemplary configuration of the bulb shape LED lamp according to the present embodiment.

A second bulb shape LED lamp 110 of the present embodiment as shown in FIG. 7 is different from the first bulb shape lamp 100 as described above with reference to FIG. 6 only in the position where the film capacitor 2 as the life detecting element is arranged. Thus, the same constituent members as those of the first bulb shape LED lamp 100 are denoted with the same reference numerals, and a description thereof will be omitted.

In the second bulb shape LED lamp 110 of the present embodiment, the film capacitor 2 that also serves as a circuit component of the driving circuit is arranged on the periphery of the driving circuit board 15 in the housing 14. With this arrangement, the film capacitor 2 of the second bulb shape LED lamp 110 detects heat generated when the LED 1 is turned on from a side portion 14*b* of the lamp housing 14 via the LED mounting board 11 and the heat sink plate 12. To this end, the film capacitor 2 in the second bulb shape LED lamp 110 is arranged at a distance x of 10 mm or less as a predetermined value from the side portion 14*b* of the lamp housing 14.

As described above, the second bulb shape LED lamp 110 of the present embodiment uses the film capacitor 2 also as a circuit component constituting the driving circuit, thereby detecting a time during which the LED 1 is turned on and turning off at least a part of the LED 1 after a predetermined operating time has elapsed, without adding a special element dedicated to detecting the lamp life. Further, since the film capacitor 2 is arranged in a peripheral portion of the driving circuit board, and detects heat generated by the LED 1 from the side portion 14*b* of the housing 14, other driving circuit components can be kept away from the heat source. As a result, the bulb shape LED lamp 110 can ensure high reliability with the driving circuit that operates stably.

Figure 8:
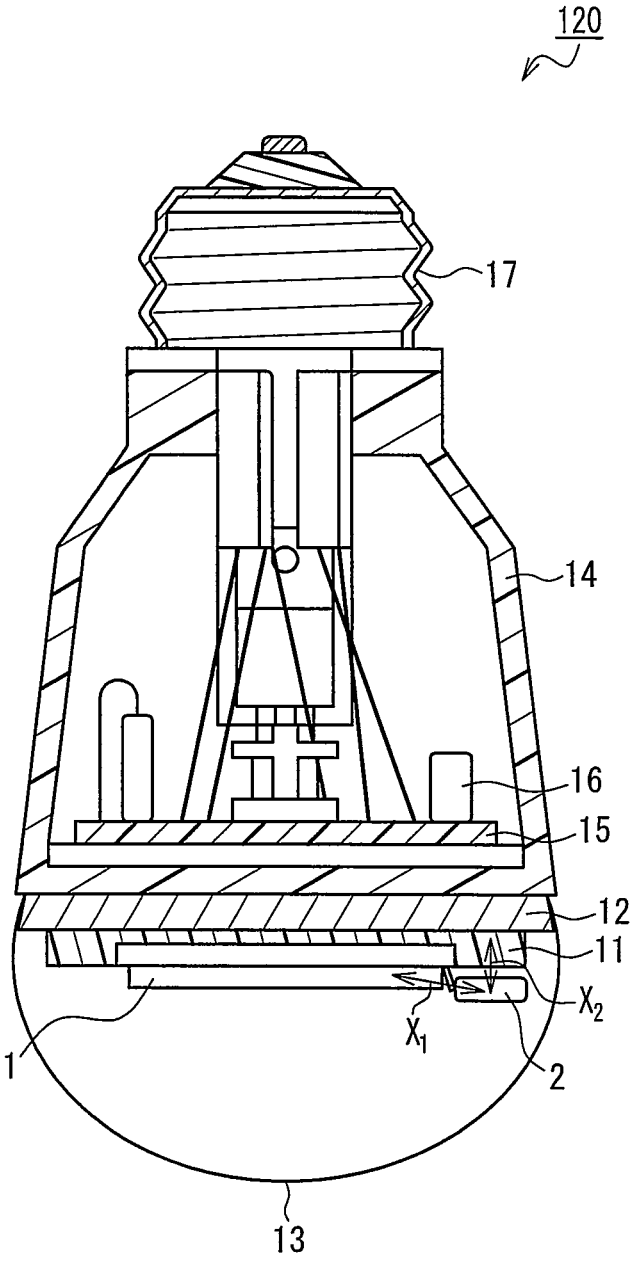
FIG. 8 is a cross-sectional view showing a third specific configuration of the bulb shape lamp as a production example of the lamp according to the embodiment of the present invention.

FIG. 8 is a cross-sectional view showing a third exemplary configuration of the bulb shape LED lamp according to the present embodiment.

A third bulb shape LED lamp 120 of the present embodiment as shown in FIG. 8 is different from the first bulb shape lamp 100 as described above with reference to FIG. 6 only in the position where the film capacitor 2 as the life detecting element is arranged. Thus, the same constituent members as those of the first bulb shape LED lamp 100 are denoted with the same reference numerals, and a description thereof will be omitted, as in the case of the second bulb shape LED lamp 110.

In the third bulb shape LED lamp 120 of the present embodiment, the film capacitor 2 connected in parallel with a serial connection body of the LED 1 is arranged on the periphery of a position where the LED 1 is mounted on the LED mounting board 11. With this arrangement, the film capacitor 2 of the third bulb shape LED lamp 120 detects heat generated when the LED 1 is turned on directly from the LED 1. To this end, the film capacitor 2 in the third bulb shape LED lamp 120 is arranged at a distance x1 of 10 mm or less as a predetermined value from the LED 1. At the same time, since the film capacitor 2 is arranged on the LED mounting board 11 to which heat generated by the LED 1 is transferred first, it also can detect heat of the LED mounting board 11. To this end, the film capacitor 2 is arranged at a distance x2 of 10 mm or less as a predetermined value from the LED mounting board 11.

As described above, the third bulb shape LED lamp 120 of the present embodiment allows the film capacitor 2 to detect heat of the LED 1 as an original heat generation source and heat of the LED mounting board 11 as a member to which heat generated by the LED 1 is transferred first, thereby more precisely detecting that the LED 1 is turned on. Consequently, even in the case where, for example, the bulb shape LED lamp 120 is used at a place where an ambient temperature variation is great, it is possible to precisely detect a time during which the LED 1 is turned on and turn off the LED 1 after a predetermined operating time has elapsed.

Figure 9:
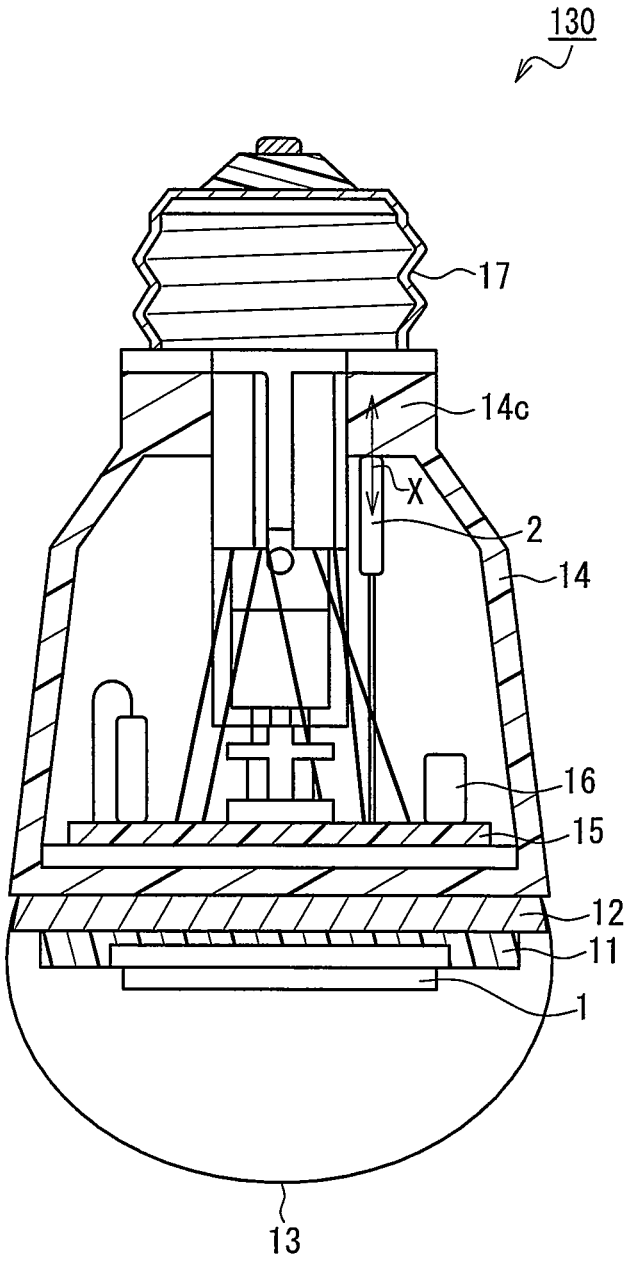
FIG. 9 is a cross-sectional view showing a fourth specific configuration of the bulb shape lamp as a production example of the lamp according to the embodiment of the present invention.

FIG. 9 is a cross-sectional view showing a fourth exemplary configuration of the bulb shape LED lamp according to the present embodiment.

In a fourth bulb shape LED lamp 130 of the present embodiment as shown in FIG. 9, the film capacitor 2 is arranged close to a portion 14*c* of the lamp housing 14 that is connected to the base 17. With this arrangement, the film capacitor 2 of the fourth bulb shape LED lamp 130 detects heat generated when the LED 1 is turned on from the portion 14*c* of the lamp housing 14 in the vicinity of the base via the LED mounting board 11 and the heat sink plate 12. To this end, the film capacitor 2 in the fourth bulb shape LED lamp 130 is arranged at a distance x of 10 mm or less as a predetermined value from the portion 14*c* of the lamp housing 14 in the vicinity of the base.

As described above, in the fourth bulb shape LED lamp 130 of the present embodiment, the film capacitor 2 is kept away from the other circuit components 15 on the driving circuit board 15, thereby detecting heat generated by the LED 1 without detecting heat generated by the circuit components constituting the driving circuit as a noise. Consequently, even in the case where the driving circuit of the bulb shape LED lamp 130 includes a member that generates great heat, it is possible to precisely detect a time during which the LED 1 is turned on and turn off the LED 1 after a predetermined operating time has elapsed.

(Exemplary Configuration of Straight Tube LED Lamp)

Next, a description will be given of exemplary configurations of a straight tube LED lamp as the lamp of the present embodiment that can replace a straight tube fluorescent lamp.

Figure 10:
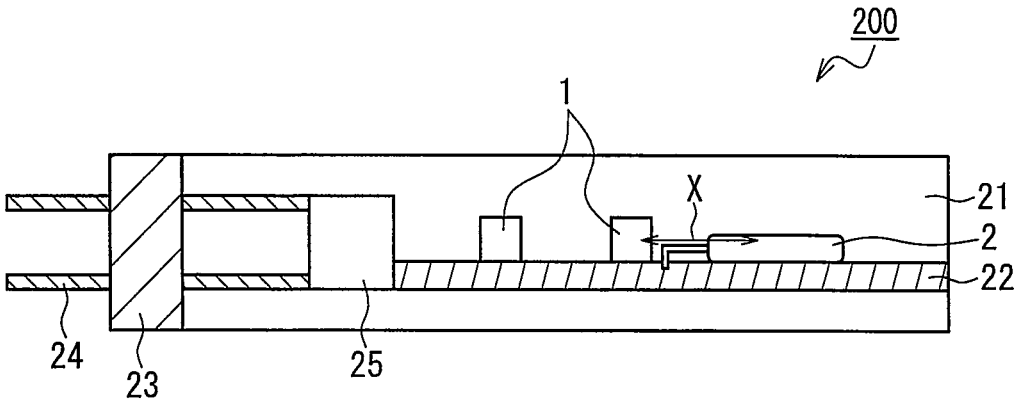
FIG. 10 is a cross-sectional view showing a first specific configuration of a straight tube lamp as a production example of the lamp according to the embodiment of the present invention.

FIG. 10 is a cross-sectional view showing a first exemplary configuration of a straight tube LED lamp as the lamp of the present embodiment.

As shown in FIG. 10, in a first straight tube LED lamp 200 of the present embodiment, an LED mounting board 22 made of metal such as aluminum, resin such as glass epoxy, ceramic, or glass, on which the LEDs 1 as light sources are mounted and that also serves as a heat sink plate is arranged in a transparent or semitransparent tubular housing 21 made of resin, glass, ceramic, or metal such as aluminum. An end of the LED mounting board 22 is connected to a driving circuit portion 25 accommodating the LED driving circuit. On the LED mounting board 22, wiring not shown is formed, allowing a constant current for operating the LEDs 1 to be applied from the driving circuit portion 25. Although FIG. 10 shows two LEDs 1 arranged as light sources on the LED mounting board 22, the number of the LEDs 1 to be arranged as light sources in the present embodiment is not limited to two, and one or more LEDs 1 may be used. Further, needless to say, the surface LED 1 as used in the bulb shape LED lamps 100, 110, 120, and 130 shown in FIGS. 6 to 9, respectively, also can be used.

Electrode pins 24 extend from an end portion of the driving circuit portion 25 on a side opposite to the LED mounting board 22 and penetrate an outer frame portion 23 of the housing 21 to the outside of the straight tube LED lamp 200. When an alternating or direct voltage is applied to the electrode pins 24, the LEDs 1 are turned on. The LED driving circuit formed in the driving circuit portion 25 of the first straight tube LED lamp 200 of the present embodiment may be a conventional driving circuit for an LED lamp, and thus it is not shown in the drawing, and a detailed description thereof will be omitted.

The film capacitor 2 as the life detecting element is arranged close to the LEDs 1 on a side of the LED mounting board 22 where the LEDs 1 are mounted. In the first straight tube LED lamp 200 of the present embodiment, the film capacitor 2 is arranged at a distance x of 10 mm or less as a predetermined value from the LEDs 1 so as to detect heat generated when the LEDs1 are turned on directly from the LEDs 1.

As described above, in the first straight tube LED lamp 200 of the present embodiment, the film capacitor 2 is arranged in the vicinity of the LEDs 1, thereby precisely detecting that the LEDs 1 are turned on.

Figure 11:
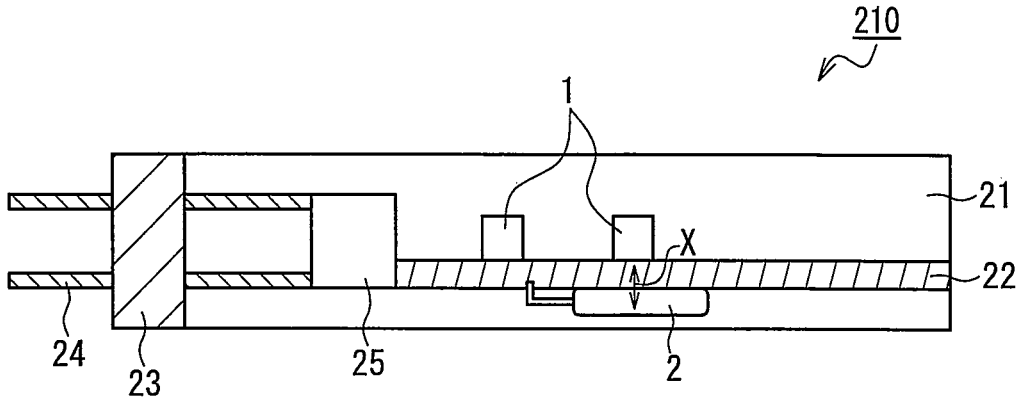
FIG. 11 is a cross-sectional view showing a second specific configuration of the straight tube lamp as a production example of the lamp according to the embodiment of the present invention.

FIG. 11 is a cross-sectional view showing a second exemplary configuration of the straight tube LED lamp according to the present embodiment.

A second straight tube LED lamp 210 of the present embodiment as shown in FIG. 11 is different from the first straight tube LED lamp 200 as described above with reference to FIG. 10 only in the position where the film capacitor 2 as the life detecting element is arranged. Thus, the same constituent members as those of the first straight tube LED lamp 200 are denoted with the same reference numerals, and a description thereof will be omitted.

In the second straight tube LED lamp 210 of the present embodiment, the film capacitor 2 is arranged on a rear surface side of the LED mounting board 22 opposite to the LEDs 1. With this arrangement, the film capacitor 2 of the second straight tube LED lamp 210 detects heat generated when the LEDs 1 are turned on via the LED mounting board 22. To this end, the film capacitor 2 in the second straight tube LED lamp 210 is arranged at a distance x of 10 mm or less as a predetermined value from the LED mounting board 22. However, there is actually no particular harm in arranging the film capacitor 2 in intimate contact with the LED mounting board 22 as shown in FIG. 11, and this arrangement allows the film capacitor 2 to precisely detect the temperature of the LED mounting board 22 that rises due to heat generated by the operation of the LEDs 1.

As described above, in the second straight tube LED lamp 210 of the present embodiment, since the film capacitor 2 is arranged on the back surface side of the LED mounting board 22, it does not block light emitted from the LEDs 1, resulting in an improved margin of selection of the position where the film capacitor 2 is to be arranged. Further, by arranging the film capacitor 2 in intimate contact with the LED mounting board 22 to which an increased temperature of the LEDs 1 is transmitted, the film capacitor 2 can detect a rise in temperature of the LEDs 1 precisely.

Figure 12:
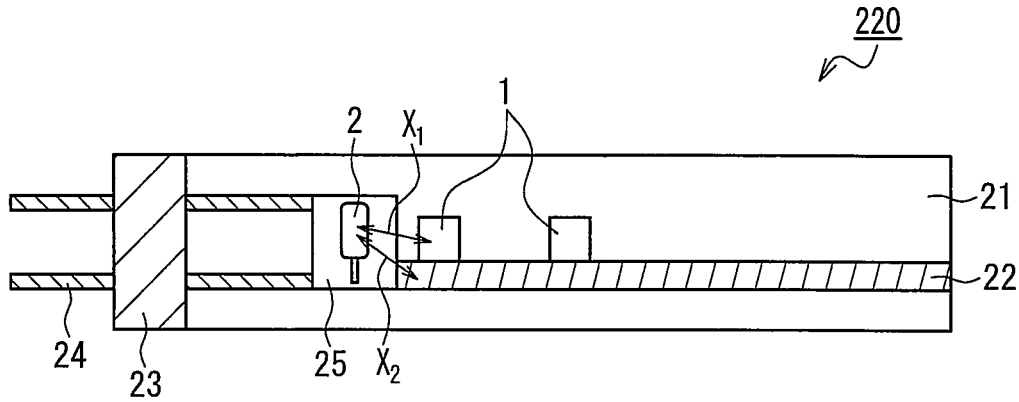
FIG. 12 is a cross-sectional view showing a third specific configuration of the straight tube lamp as a production example of the lamp according to the embodiment of the present invention.

FIG. 12 is a cross-sectional view showing a third exemplary configuration of the straight tube LED lamp according to the present embodiment.

A third straight tube LED lamp 220 of the present embodiment as shown in FIG. 12 is also different from the first straight tube LED lamp 200 only in the position where the film capacitor 2 as the life detecting element is arranged. Thus, the same constituent members are denoted with the same reference numerals, and a description thereof will be omitted.

In the third straight tube LED lamp 220 of the present embodiment, the film capacitor 2 also serves as a capacitor of the LED driving circuit and is arranged in the driving circuit portion 25. Namely, in the third straight tube LED lamp 220, the film capacitor 2 is not arranged as an additional member for detecting that the LEDs 1 are turned on but arranged in the driving circuit 25 for turning on the LEDs 1, thereby detecting heat generated when the LEDs 1 are turned on. To this end, the film capacitor 2 is arranged at a distance x1 of 10 mm or less as a predetermined value from the LEDs 1. Further, the driving circuit portion 25 and the LED mounting board 22 are connected to each other, which allows the film capacitor 2 to detect heat of the LEDs 1 also from the LED mounting board 22 to which heat generated by the LEDs 1 is transferred first. In this case, the film capacitor 2 is arranged at a distance x2 of 10 mm or less as a predetermined value from the LED mounting board 22.

As described above, the third straight tube LED lamp 220 of the present embodiment uses the film capacitor 2 also as a circuit component constituting the LED driving circuit, thereby detecting a time during which the LEDs 1 are turned on and turning off at least a part of the LEDs 1 after a predetermined operating time has elapsed, without adding a special element dedicated to detecting the lamp life. Further, since the driving circuit portion 25 is connected to the LED mounting board 22, the film capacitor 2 detects heat generated by the LEDs 1 directly and via the LED mounting board 22, thereby precisely detecting a time during which the LEDs 1 are turned on.

Figure 13:
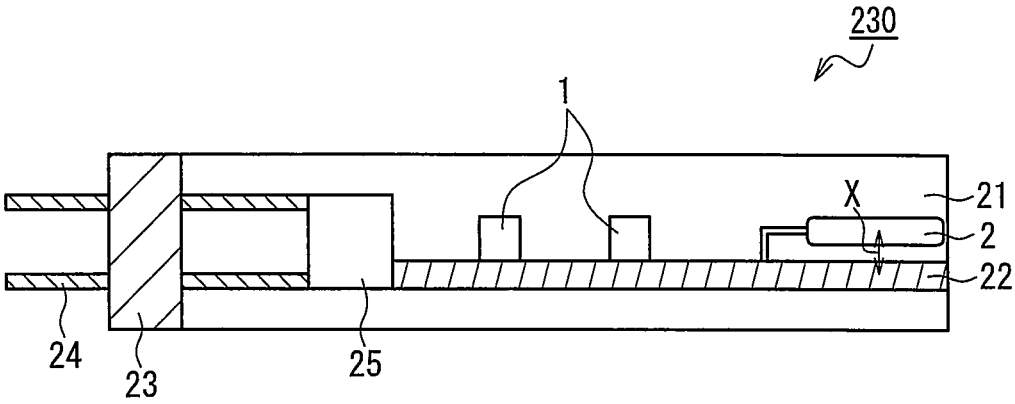
FIG. 13 is a cross-sectional view showing a fourth specific configuration of the straight tube lamp as a production example of the lamp according to the embodiment of the present invention.

FIG. 13 is a cross-sectional view showing a fourth exemplary configuration of the straight tube LED lamp according to the present embodiment.

In a fourth straight tube LED lamp 230 of the present embodiment as shown in FIG. 13, the film capacitor 2 is arranged on a side of the LED mounting board 22 where the LEDs 1 are mounted at a larger distance from the LEDs 1 than in the first straight tube LED lamp 200 shown in FIG. 10.

The fourth straight tube LED lamp 230 as shown in FIG. 13 has a configuration intended for the case where the film capacitor 2 cannot be arranged close to the LEDs 1 on the LED mounting board 22, such as the case where there are restrictions in the arrangement and distribution of the light sources of the straight tube LED lamp 230 as a whole. In the case where the film capacitor 2 is arranged on the LED mounting board 22 but cannot be arranged in the vicinity of the LEDs 1, the LED mounting board 22 is made of a high thermal conductive material, thereby allowing the film capacitor 2 to detect heat generated by the LEDs 1 via the LED mounting board 22. To this end, the film capacitor 2 in the fourth straight tube LED lamp 230 is arranged at a distance x of 10 mm or less as a predetermined value from the LED mounting board 22, and more preferably on the LED mounting board 22 in intimate contact therewith, if possible.

As described above, in the fourth straight tube LED lamp 230 of the present embodiment, even in the case where, for example, the film capacitor 2 cannot be arranged close to the LEDs 1 on the LED mounting board 22, the film capacitor 2 can detect heat generated by the LEDs 1 via the LED mounting board 22. Therefore, the straight tube LED lamp 230 can achieve an excellent emission brightness distribution.

(Exemplary Configuration of GX Base Lamp)

Next, a description will be given of exemplary configurations of a GX base LED lamp as the lamp of the present embodiment that can replace a lamp with a GX base pin such as a halogen lamp.

Figure 14:
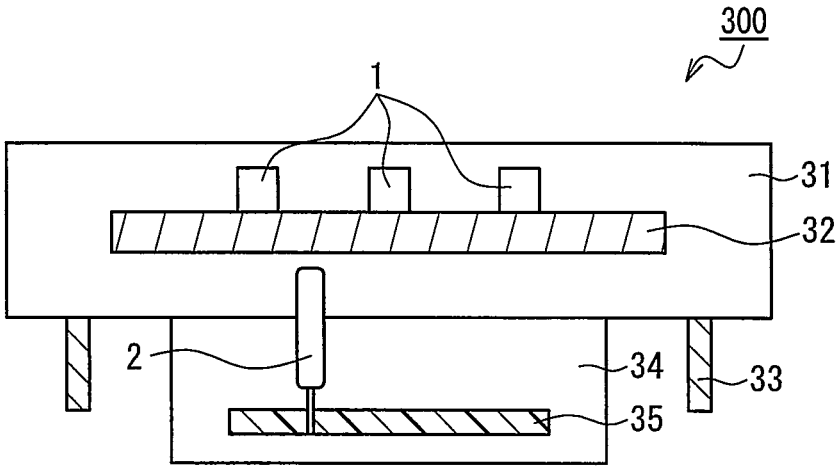
FIG. 14 is a cross-sectional view showing a first specific configuration of a GX base lamp as a production example of the lamp according to the embodiment of the present invention.

FIG. 14 is a cross-sectional view showing a first exemplary configuration of a GX base LED lamp as the lamp of the present embodiment.

As shown in FIG. 14, in a first GX base LED lamp 300 of the present embodiment, an LED mounting board 32 made of resin, glass, ceramic, or metal such as aluminum on which the LEDs 1 as light sources are mounted and that also serves as a heat sink plate is arranged in a transparent or semitransparent housing 31 made of resin, glass, ceramic, or metal such as aluminum.

Although FIG. 14 shows three LEDs 1 arranged as light sources on the LED mounting board 32, the number of the LEDs 1 to be arranged as light sources in the GX base LED lamp 300 of the present embodiment is not limited to three, and one, two, or more LEDs 1 may be used. Further, the surface LED 1 as used in the bulb shape LED lamps 100, 110, 120, and 130 shown in FIGS. 6 to 9, respectively, also can be used.

Electrodes 33 are formed on a back surface side of the housing 31, and a driving circuit portion 34 accommodating an LED driving circuit for supplying a constant current to turn on the LEDs 1 is arranged in a central portion on the back surface of the housing 31. A capacitor as a driving circuit component arranged on a circuit board 35 in the driving circuit portion 34 also serves as the film capacitor 2 as the life detecting element. The LED driving circuit that is formed in the driving circuit portion 34 and turns on the LEDs 1 by an alternating voltage applied to the electrode pins 33 may be a conventional driving circuit for an LED lamp, and thus it is not shown in the drawing, and a detailed description thereof will be omitted.

In the first GX base LED lamp 300 of the present embodiment, since the film capacitor 2 as the life detecting element is formed as a circuit component of the LED driving circuit, it needs to be arranged at a distance of 10 mm or less as a predetermined value from the LED mounting board 32 on which the LEDs 1 are mounted. To this end, as shown in FIG. 14, the film capacitor 2, which is originally a tall component, is arranged so as to protrude from the driving circuit portion 34 to the inside of the housing 31.

As described above, in the first GX base LED lamp 300 of the present embodiment, the film capacitor 2 is arranged in the vicinity of the LED mounting board 32 in the housing 31, thereby precisely detecting that the LEDs 1 are turned on.

Figure 15:
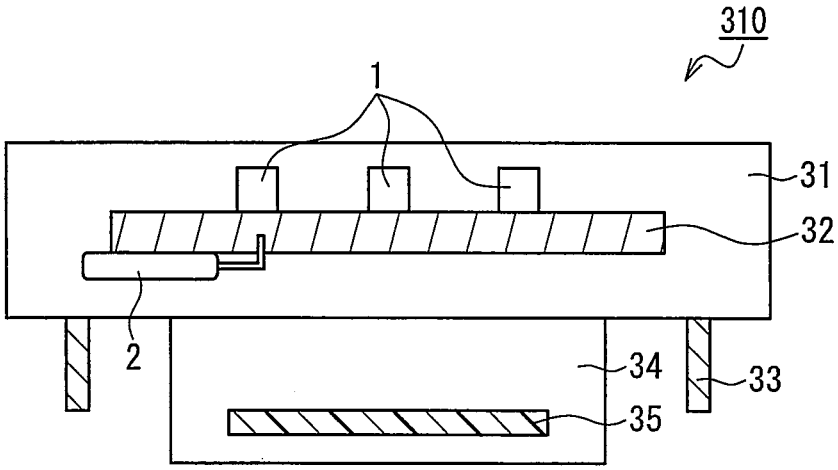
FIG. 15 is a cross-sectional view showing a second specific configuration of the GX base lamp as a production example of the lamp according to the embodiment of the present invention.

FIG. 15 is a cross-sectional view showing a second exemplary configuration of the GX base LED lamp according to the present embodiment.

A second GX base LED lamp 310 of the present embodiment as shown in FIG. 15 is different from the first GX base LED lamp 300 as described with reference to FIG. 14 only in the position where the film capacitor 2 as the life detecting element is arranged. Thus, the same constituent members as those of the first GX base LED lamp 300 are denoted with the same reference numerals, and a description thereof will be omitted.

In the second GX base LED lamp 310 of the present embodiment, the film capacitor 2 connected in parallel with the LEDs 1 is arranged on a rear surface side of the LED mounting board 32 opposite to the LEDs 1. With this arrangement, the film capacitor 2 detects heat generated when the LEDs 1 are turned on via the LED mounting board 32. To this end, the film capacitor 2 is arranged at a distance x of 10 mm or less as a predetermined value from the LED mounting board 32. However, there is actually no particular harm in arranging the film capacitor 2 in intimate contact with the LED mounting board 32 as shown in FIG. 15, and this arrangement allows the film capacitor 2 to precisely detect the temperature of the LED mounting board 32 that rises due to heat generated by the operation of the LEDs 1.

As described above, in the second GX base LED lamp 310 of the present embodiment, the film capacitor 2 is arranged on the back surface side of the LED mounting board 32, resulting in an improved margin of selection of the position where the film capacitor 2 is to be arranged. Further, by arranging the film capacitor 2 in intimate contact with the LED mounting board 32 to which an increased temperature of the LEDs 1 is transmitted, the film capacitor 2 can detect a rise in temperature of the LEDs 1 precisely.

(Exemplary Configuration of Other Lamp Units)

Figure 16:
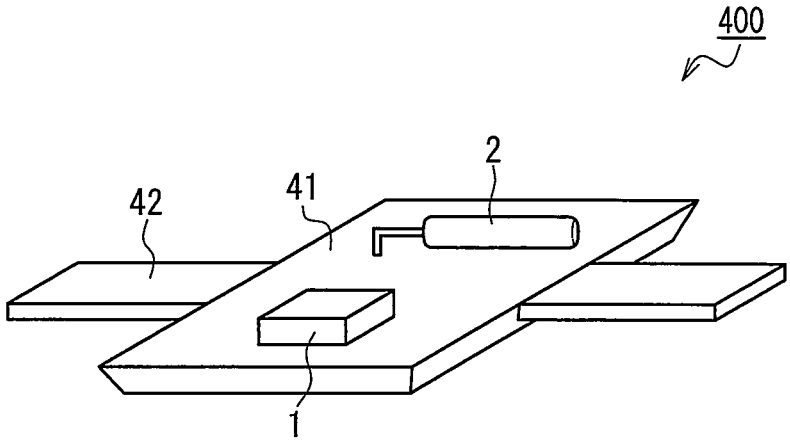
FIG. 16 is a cross-sectional view showing a specific configuration of an LED module as a production example of the lamp according to the embodiment of the present invention.

FIG. 16 is a cross-sectional view showing an exemplary configuration of an LED module as the LED lamp of the present embodiment.

As shown in FIG. 16, in an LED module 400 of the present embodiment, the LED 1 as a light source and the film capacitor 2 as the life detecting element connected in parallel with the LED 1 are arranged on a module substrate 41. The module substrate 41 is provided with input terminals 42 to which a drive voltage for turning on the LED 1 is applied externally.

Although FIG. 16 shows only one LED 1 arranged as a light source on the module substrate 41, the number of the LEDs 1 to be arranged as light sources in the LED module 400 of the present embodiment is not limited to one. Further, the LED driving circuit may be arranged on the module substrate 41 appropriately in connection with the application of the module.

As described above, since the LED module 400 as the LED lamp of the present embodiment is mounted with the film capacitor 2 that detects heat generated when the LED 1 is operated, it is possible to turn off the LED 1 when the LED 1 has been operated for more than a predetermined time and urge a user to replace the LED module 400 before the circuit components other than the LED 1 used in the LED module 400 come to the end of their life.

Figure 17:
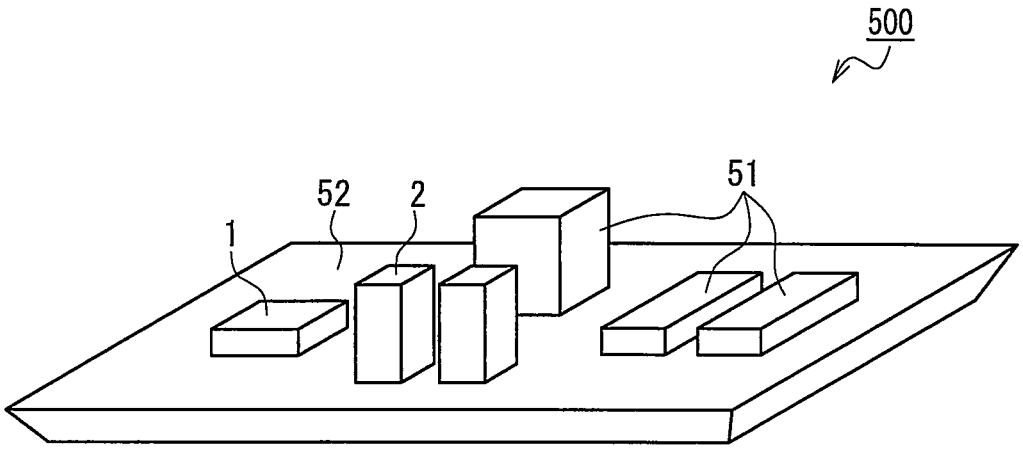
FIG. 17 is a cross-sectional view showing a specific configuration of an LED chip-on-board as a production example of the lamp according to the embodiment of the present invention.

FIG. 17 is a cross-sectional view showing an exemplary configuration of an LED chip-on-board as the LED lamp of the present embodiment.

As shown in FIG. 17, according to a board 500 of the present embodiment on which the LED is mounted, the LED 1 as a light source, the film capacitor 2 as the life detecting element connected in parallel with the LED 1, and other circuit components 51 are arranged on a board substrate 52.

As described above, by arranging the film capacitor 2 as the life detecting element close to the LED 1 on the board substrate 52 on which the LED 1 is mounted, it is possible to turn off the LED 1 when the LED 1 has been operated for more than a predetermined time and urge a user to replace the board 500 before the various circuit components 51 and the like on the board substrate 52 on which the LED is mounted come to the end of their life.

Although the above exemplary configurations of the LED lamp according to the embodiment of the present invention have been described taking as examples only the cases where the film capacitor is used as the life detecting element, the film capacitor can be replaced by a coil having a coil winding with an insulating coating film made of resin as stated in the description of the life detecting element.

Further, it is not necessary for the life detecting element to take the form of a circuit component such as the film capacitor and the coil. The life detecting element configured to detect life, such as a member in which an electrode is arranged via a resin film, can be arranged at a position where it can detect the temperature of the LED 1 directly or indirectly during the operation of the LED 1.

Further, the life detecting element of the present invention is not limited to the one that utilizes insulation deterioration in the resin film as long as the life detecting element itself has a mechanism capable of detecting the operating time of the LED and turning off the LED after a predetermined time has elapsed.

INDUSTRIAL APPLICABILITY

The lamp according to the present invention that uses a low-power and long-life LED as a light source and can manage its life as a whole is available as various lamps such as an alternative to an existing lamp.

The invention claimed is:

1. A lamp comprising:

a light emitting diode as a light source; and a driving circuit that turns on the light emitting diode by an alternating-current or direct-current power source, wherein the lamp further comprises a life detecting element that turns off the light emitting diode before occurrence of reduction of brightness of the light emitting diode by blocking a current that turns on the light emitting diode subsequent to the occurrence of insulation failure of a resin material in the life detecting element due to heat produced by the light emitting diode when the light emitting diode has been operated for a predetermined time; and the life detecting element is arranged at a distance of 10 mm or less from a light emitting portion of the light emitting diode or a member for transferring heat produced by the light emitting diode.

2. The lamp according to claim 1, wherein the life detecting element is a foil-type film capacitor arranged in parallel with at least a part of the light emitting diode.

3. The lamp according to claim 1, wherein the life detecting element is a foil-type film capacitor constituting the driving circuit for the light emitting diode.

4. The lamp according to claim 1, wherein the life detecting element is a coil having a resin-coated winding.

5. The lamp according to claim 1, wherein the light emitting diode has a temperature of 50° C. or more during operation.

6. The lamp according claim 1, wherein the member for transferring heat produced by the light emitting diode is a heat sink plate provided for dissipating heat of the light emitting diode or a housing accommodating the light emitting diode.

7. The lamp according to claim 6, wherein the heat sink plate or the housing has a temperature of 50° C. or more during an operation of the light emitting diode.

8. The lamp according to claim 1, wherein the predetermined time is set equal to or shorter than a life of the driving circuit.

9. A lamp comprising:

a light emitting diode; and a driving circuit that turns on the light emitting diode, wherein the lamp further comprises a life detecting element that turns off the light emitting diode before occurrence of reduction of brightness of the light emitting diode by blocking a current that turns on the light emitting diode based on a change in electrical characteristics that occurs depending on an operating time of the light emitting diode; and the life detecting element is arranged at a distance of 10 mm or less from a light emitting portion of the light emitting diode or a member for transferring heat produced by the light emitting diode.

10. The lamp according to claim 9, wherein the change in electric characteristics occurs when a predetermined time that is set equal to or shorter than a life of the driving circuit is elapsed.

* * * * *